United States Patent [19]

Turney

[11] Patent Number: 4,495,445

[45] Date of Patent: Jan. 22, 1985

[54] BRIGHTNESS CONTROL FOR A VACUUM FLUORESCENT DISPLAY

[75] Inventor: Stephen D. Turney, New Hartford, N.Y.

[73] Assignee: General Electric Co., New York, N.Y.

[21] Appl. No.: 501,385

[22] Filed: Jun. 6, 1983

[51] Int. Cl.[3] ..... H05B 37/00

[52] U.S. Cl. ..... 315/169.1; 315/169.4; 315/209 R; 315/287; 315/DIG. 4; 340/767; 340/813

[58] Field of Search ..... 340/813, 767; 315/169.1, 169.4, 209 R, 287, DIG. 4

[56] References Cited

U.S. PATENT DOCUMENTS

| | | | |
|---|---|---|---|
| 4,090,189 | 5/1978 | Fisler | 315/169.1 |
| 4,158,794 | 6/1979 | Sandler | 315/107 |
| 4,241,294 | 12/1980 | Fisler | 315/169.1 |
| 4,358,713 | 11/1982 | Senoo | 315/169.1 |

*Primary Examiner*—Harold Dixon

*Attorney, Agent, or Firm*—George R. Powers

[57] ABSTRACT

A vacuum fluorescent display is provided with control means for turning on the display elements by means of a control signal which is in phase with the AC voltage supplied to the cathode of the display. The control signal has a duty cycle which is symmetrical about the zero crossing points of the AC voltage. As a result, the display produces light output only during time periods that are symmetrical about the zero crossings of the AC voltage. In this manner, uniform brightness of the display is perceived.

22 Claims, 15 Drawing Figures

BRIGHTNESS CONTROL FOR A VACUUM FLUORESCENT DISPLAY

FIELD OF THE INVENTION

This invention relates to electronic displays such as vacuum fluorescent displays and, more particularly, to a control for producing at each selected brightness level substantially uniform light output across the entire display. The control of this invention turns on the display elements by means of a control signal which is in phase with the AC voltage supplied to the cathode of the display. The control signal has a duty cycle which is approximately symmetrical about the zero crossing points of the AC voltage. As a result, the display produces light output only during time periods that are symmetrical about the zero crossings of the AC supply voltage to the display cathode.

DESCRIPTION OF THE PRIOR ART

In known brightness control circuits for electronic displays, the current supplied to the display element is often controlled as a function of the amount of illumination required. It is known, for instance, to employ a variable resistance to control the level of a display energizing current. In addition to being inefficient, such a control circuit has a limited operable range over which the display illumination can be uniformly controlled. Moreover, at low power or brightness levels, such a control circuit tends to turn the display off. Further, such a control circuit is subject to temperature instabilities and wide variations in component tolerances, which cause the display to produce non-uniform illumination.

U.S. Pat. No. 4,090,189 discloses an LED display control circuit in which an energizing current flows from a source of energizing potential to an LED electronic display through a Darlington transistor switch, which causes the energizing current to be supplied as pulses of constant peak current to the display elements. The transistor switch is controlled to periodically turn the display on and off. The duty cycle of the circuit is varied to control the brightness of the display. The Darlington transistor switch is driven by a DC potential which is periodically shorted by a capacitively triggered control circuit. The capacitor is charged through a series connected charging circuit including a brightness control variable resistor which can be manually adjusted to correspond to a selected brightness level and establish the capacitor charging rate. The capacitor charges at a variable rate determined by the brightness setting. The capacitor voltage thus takes proprotionate lengths of time to reach a fixed threshold voltage level, e.g. the threshold voltage level is reached much quicker at the minimum brightness setting than at the maximum brightness setting. Since a capacitor cannot charge instantaneously, a finite (minimum) time period is required to charge the capacitor to the threshold level at the minimum brightness setting. The display, as will be explained below, it turned "on" unless the capacitor level exceeds the threshold voltage, at which point the display is turned "off." More particularly a threshold voltage sensing transistor has its base coupled to the capacitor through a current limiting resistor, has its emitter coupled to ground and has its collector coupled to the base of the Darlington transistor switch. The threshold sensing transistor responds to the voltage across the capacitor and provides, at its collector output, a display drive signal which shorts the base of the Darlington transistor switch to ground. The duty cycle of the display drive signal is related to the period of time during which the capacitor voltage exceeds the threshold voltage.

U.S. Pat. No. 4,241,294 pertains to a Brightness Control Circuit for a Vacuum Fluorescent Display and also employs a capacitor driven control circuit. A capacitor is provided having a first terminal coupled to a source of DC power and a second terminal coupled to ground through an adjustable brightness control resistor. The second terminal of the capacitor is also coupled to the cathode of a diode whose anode is coupled to ground. The collector of a ground emitter discharge transistor is also coupled to the first terminal of the capacitor. The base of the discharge transistor is coupled to one leg of a transformer secondary whose primary is connected to an AC source. In operation, the secondary produces a signal which, during even numbered half cycles, forward biases the discharge transistor to discharge the capacitor. During odd numbered half cycles, the discharge transistor is not forward biased and the capacitor is allowed to charge. A voltage signal related to the rate of capacitor charging is developed at the second terminal of the capacitor. Initially as a fully discharged capacitor begins to charge, a maximum level voltage signal appears at the second terminal of the capacitor. As the capacitor becomes more charged, the level of the voltage signal decreases. The brightness control resistor establishes the rate at which the capacitor charges and also establishes the rate at which the level of the voltage signal decreases.

The voltage signal is used to drive a differential amplifier which, in turn, drives a display control transistor. The generated voltage signal is applied to the base of the first transistor of the differential amplifier and a preselected voltage is applied to the second transistor of the differential amplifier. When the level of the generated voltage signal is less than the prespecified voltage, the second transistor is forward biased and the first transistor is off. When the generated voltage exceeds the prespecified voltage, the first transistor becomes forward biased, shorting to ground the collector and base power supply for the second transistor of the differential amplifier to prevent the second transistor from becoming forward biased. The display control transistor includes a base which is coupled to the collector of the second transistor, a collector which is coupled to the segment circuit of the display and an emitter which is coupled to ground. When the second transistor of the differential amplifier is on, the display transistor and the display is off. However, when the first transistor of the differential amplifier is on, the second transistor is off and the display is on. The first transistor is on whenever the level of the generated voltage signal exceeds the prespecified voltage. The duration of the time period during which the generated voltage signal exceeds the prespecified voltage is established by the brightness control resistor which establishes the charging rate of the capacitor. A low charging rate ensures that the voltage signal will be high for a longer period of time, causing the display to be illuminated for a longer period of time. The duty cycle of the voltage signal is related to the RC time constant of the brightness control resistor and the capacitor. Since a capacitor cannot charge instantaneously, the display will be turned on for some finite time interval each odd numbered half cycle.

U.S. Pat. No. 4,158,794, for a Drive Means and Method for Vacuum Fluorescent Display Systems, the disclosure of which is expressly incorporated by reference herein, relates to a control circuit which limits cathode/filament heating to time periods when a display grid is not driven and conversely presents filament heating during periods when the display grid is driven. This off cycle filament drive overcomes a voltage drop along a cathode/filament which can otherwise cause non-uniform brightness levels between display elements. The grids are sequentially driven by rectangular pulses.

In prior art vacuum fluorescent displays, each display element in the display is provided with an individual anode element to which a selected voltage is supplied when it is desired to turn on or enable that display element. Individual display elements may or may not be provided with discrete grid elements. AC voltage is typically continuously supplied to a single combination cathode/filament extending across a number of display in proxiity to the respective anode and grid elements associated with the display elements. During operation, there can be a substantial voltage drop along the length of the cathode. The relative voltages between the cathode and separate anodes at various points in the display can also be substantial, resulting in non-uniform light output.

At high brightness levels, i.e., when display elements are turned on for a relatively long portion of each cycle of the AC potential supplied to the display, non-uniformities in the brightness of different display elements in the same display are not readily apparent. However, at low brightness levels, i.e., when the elements are turned on for a short period, non-uniformities in brightness can be easily detected by the naked eye. Such non-uniform illumination can be extremely unattractive to the viewer.

SUMMARY OF THE INVENTION

It is therefore a primary object of this invention to provide an improved brightness control circuit for electronic displays.

Another object of this invention is to provide means for making possible uniform illumination of electronic displays such as vacuum fluorescent displays over a broad range of brightness levels.

Another object of this invention is to provide a control circuit for providing substantially uniform illumination of a vacuum fluorescent display at lower brightness levels than heretofore possible.

Yet another object of the present invention is to provide an improved brightness control circuit for a vacuum fluorscent display which provides for continuous control of the display elements over a wide range of brightness levels extending particularly into the low brightness region.

An additional object is to provide the aforesaid control functions by a relatively simple circuit which can be inexpensively produced on a mass production basis.

Briefly stated, in carrying out the invention in one form, a vacuum fluorescent display having anode, grid, and cathode terminals is provided with a brightness control for providing substantially uniform illumination over a broad brightness range. The control includes means for supplying AC potential to the display cathode on a continuous basis and means for supplying suitable voltage to the anode and grid terminals of discrete elements of the display when it is desired to illuminate the discrete elements. The control means has first and second operative states and is coupled to the means for supplying AC potential. The control means is responsive to the means for supplying AC potential such that the control means assumes the second operative state only during time periods that are symmetrical about the zero crossings of the AC potential. In turn, the means for supplying the AC potential is responsive to the first operative state of the control means to supply the AC potential at a first level and is responsive to the second operative state of the control means to supply the AC potential at a second level. The elements of the vacuum fluorescent display produce light output only in response to the delivery thereto simultaneously of the selected anode and grid voltages and AC potential at the second level. As a result, light output is produced by the display only during time periods that are symmetrical about the zero crossings of the AC potential to the cathode terminals. By a further aspect of the invention, the control means includes adjustable means for selectively varying the duration of the second operative state so as to vary the on-time and perceived brightness of the vacuum fluorescent display. The adjustable means is preferably manually adjustable such that the perceived brightness can be selectively varied by an operator. The cathode is a combination element that functions as both a cathode and a heating filament such that the cathode is continuously maintained in a state to emit electrons.

By a still further aspect of the invention, the means for supplying AC potential to the cathode comprises a transformer having a secondary thereof including output terminals connected to the cathode and a tap connected to the control means. The control means in its first operative state causes the voltage of the cathode to assume the first level, and the control means in its second operative state causes the voltage of the cathode to assume the second state. The voltages along the cathode are substantially lower than the selected anode and grid voltages only when the secondary voltage is at the second level. As a result, the display is illuminated only when the secondary voltage is at the second level. The control means includes a controllable switching means having a first non-conductive state and a second conductive state connected between the secondary tap and a source of ground potential. The first and second states of the controllable switching means constitute the first and second operative states of the control means such that the potential at the tap is fixed to ground potential when the control means is in its second operative state. By yet another aspect of the invention, the controllable switching means is a semiconductor switching device including a control terminal. A first signal producing means is coupled to the transformer for producing a first control signal in phase with the AC potential to the cathode. A second signal producing means is coupled to the first signal producing means and the control terminal of the semiconductor switching device for producing in response to the first control signal a second control signal symmetrical about the zero crossings of the AC potential. The second control signal is supplied to the control terminal to turn on the semiconductor device and thereby couple the transformer tap to ground potential during the time period symmetrical about the zero crossings.

In accordance with still further aspects of the invention, the second control signal is produced during discrete portions only of each cycle of the AC potential. In accordance with preferred embodiments of the invention, the discrete portions may be produced either for continuous time periods symmetrical about and including the zero crossings or for non-continuous time periods symmetrical about but not including the zero crossings.

BRIEF DESCRIPTION OF THE DRAWINGS

The inventive idea disclosed herein is capable of receiving a variety of electrical expressions; the accompanying drawings are included for the purpose of illustrating the particular embodiments of this inventive idea and are not intended to limit the scope thereof. In these drawings.

Figure 1:
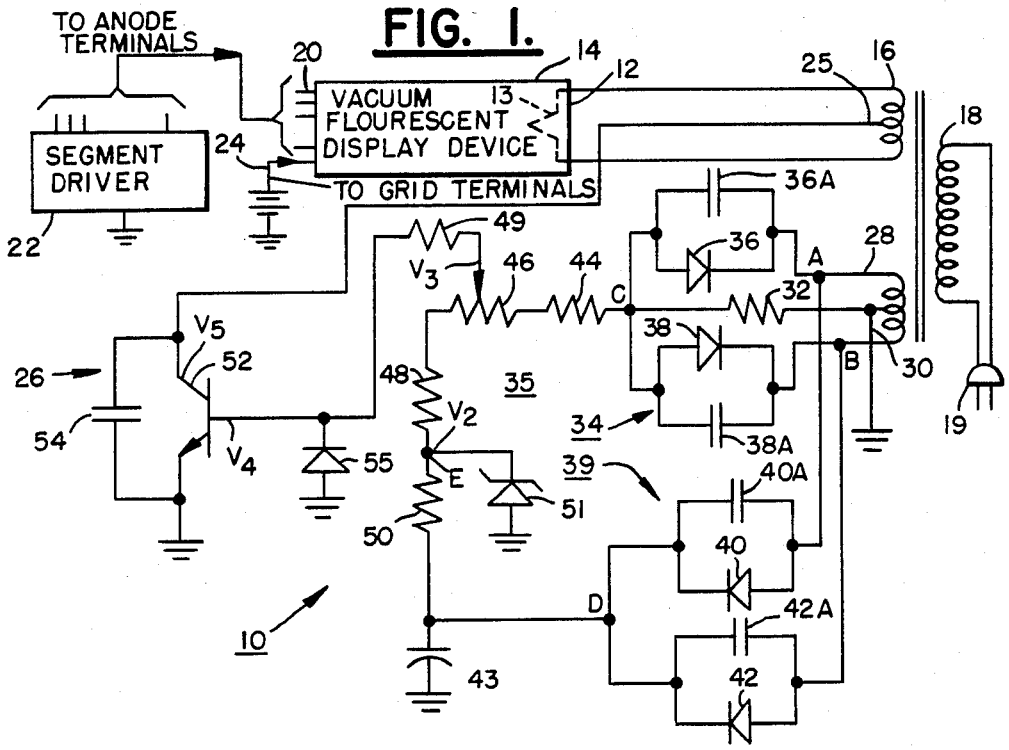
FIG. 1 is a schematic circuit diagram of a brightness control for controlling the illumination of a vaccum fluorescent display in accordance with the present invention.

FIGS. *3a–3g* illustrate typical signal potentials which appear at specified points in the control circuit of FIG. 1 as follows:

FIG. *3a* is an illustration of typical voltages produced within the vacuum fluorescent display device;

FIG. *3b* is an illustration of the signal produced at point C;

FIG. *3c* is an illustration of the signal produced at point E;

FIG. *3d* is an illustration of the signal $V_3$ provided at the wiper 47 of a variable potentiometer 46;

FIG. *3e* is an illustration of the signal $V_4$ applied to the base of a transistor 52;

FIG. *3f* is an illustration of the signal $V_5$ at the tap 25 of a transformer secondary 16; and FIG. *3g* is a view similar to FIG. *3a* showing variation in the cathode voltage in accordance with the present invention as practiced by the control circuit of FIG. 1.

Figure 2:
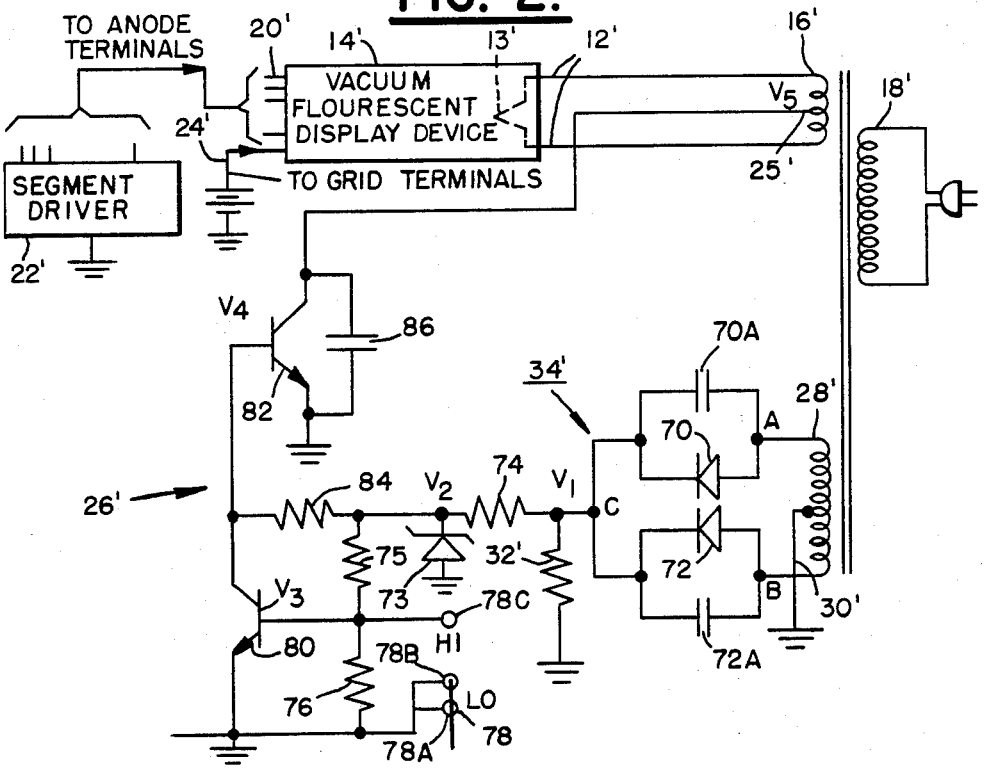
FIG. 2 is a schematic circuit diagram of an alternate embodiment of a brightness control circuit in accordance with another aspect of the present invention.

FIGS. *4a–4e* illustrate typical signal potentials which appear at specified points in the control circuit of FIG. 2 as follows:

FIG. *4a* is an illustration of the typical voltages produced within the vacuum fluorescent display device;

FIG. *4b* is an illustration of the voltage signals $V_1$ and $V_2$;

FIG. *4c* is an illustration of the signal $V_3$ applied to the base of a transistor 80;

FIG. *4d* is an illustration of the signal $V_4$ applied to the base of a transistor 82;

FIG. *4e* is an illustration of the signal $V_5$ at the tape 25' of a transformer secondary 16'; and FIG. *4f* is a view similar to FIG. *4a* showing variations in the cathode voltage in accordance with the present invention as practiced by the control circuit of FIG. 2.

DETAILED DESCRIPTION OF THE DRAWINGS

One embodiment 10 of the brightness control circuit of the present invention is illustrated by FIG. 1, in which the terminals 12 of a combined cathode and heating filament 13 of a vacuum fluorescent display 14 are coupled to the end terminals of a transformer secondary 16. The display includes a plurality of discrete display elements not illustrated which can be selectively illuminated. The transformer primary 18 is connected to a source of AC power by a plug 19. Each of the display elements is provided with its own discrete anode, and the discrete anode terminals collectively identified by the numeral 20 of the vacuum fluorescent display 14 are coupled to a segment driver 22 which includes a DC power supply. In a preferred embodiment, an integrated timer circuit similar to Sanyo part number LM-8362 can be used to enable the individual display segments on a timed basis. A vacuum flourescent display device 14 similar to Nippon Electric Company part number FIPSK15F can advantageously be used. The grid terminal 24 of the vacuum fluorescent display 14 is coupled to a DC power supply to provide as shown by FIG. *3a* a constant DC bias to the display grid. When it is desired that a selected one of the display elements of the display 14 be illuminated, the segment driver 22 supplies to the respective anode 20 a predetermined DC voltage as illustrated by FIG. *3a;* when illumination is not desired, anode voltage is not supplied.

As known to those skilled in the art, a vacuum fluorescent display segment will become illuminated when appropriate positive DC potentials are applied to both its anode and grid terminals and its cathode is simultaneously provided with a substantially lower voltage. For example, in FIG. *3a,* illumination of the respective display element is not provided during the time interval (a)–(b) even though anode voltage is supplied during periods (a)–(c) and (d)–(b). During the periods (b)–(e) and (f)–(g), however, illumination is provided. The display element is not illuminated during the period (e)–(f) because of the absence of an anode voltage.

One simple manner of properly establishing the required bias relationship is illustrated in the schematic circuit of FIG. 1 wherein the terminals 12 of the combined cathode and filament 13 are coupled to ground through a center tap 25 of the transformer secondary 16 and a controllable switching means 26. AC potential is continuously supplied to the cathode/filament 13 from the transformer secondary 16 to continuously maintain the cathode/filament 13 in a heated state in which electrons can be readily emitted. When the controllable switch 26 is conductive, the center tap 25 is connected to ground potential, and the AC potential supplied to the cathode/filament 13 varies about the ground potential $V_5$ maintained at the tap 25 as illustrated during time period (b)–(g) of FIG. *3a.* When, however, the tap 25 is not coupled to ground through the transistor 52, the cathode voltage floats to the much higher voltage existing during time period (a)–(b). During the time period (a)–(b), the cathode voltage varies about the much higher voltage $V_5$ existing at the tap 25, the voltage $V_5$ being approximately the same as the grid voltage V grid. Under both situations, the AC potential across the terminals 12 continuously provides heating current to the cathode/filament 13.

When the center tap 25 of the filament secondary 16 is grounded, the absolute value of the potential at any point along the length of the cathode/filament 13 is much lower than it is when the center tap 16 is not grounded. Under these circumstances, selected display elements of the display 14 can be illuminated by applying positive DC potentials to the grid terminal 24 and the respective anode terminal 20. More particularly, such biasing causes electrons to flow from the cathode 12 through the grid 24 to the anode 20, causing the selected segment of the display 14 to fluoresce or become illuminated. Whenever the cathode 12 is at such a low absolute potential relative to a more positive DC potential grid 24, the display elements of the display 14 are in an enabled state and may be selectively turned on by applying an appropriate potential to the anode 20 of the selected segment from the segment driver 22 to cause the selected segment of the display fluoresce or become illuminated. When, however, the transformer tap 25 is not grounded, the AC potential at all points along the cathode/filament 13 is continuously high enough to prevent illumination even when the segment driver 22 supplies normal turn-on potential to selected anodes.

The controllable switching means 26 comprises a transistor 52 driven by a means 34 for generating a signal symmetrical in time about the zero crossing point of the output AC potential of the secondary 16 of the transformer and a means 35 for coupling the symmetrical signal to the base of the transistor 52 to turn on the transistor 52 and thereby connect the transformer tap 25 to ground. The transistor 52 may be said to have a first, non-conductive operative state when it is not turned on and a second, conductive operative state when it is turned on to couple tap 25 to ground. In a preferred embodiment, the coupling means 35 advantageously includes at least one variable element such as a variable potentiometer 46. The function of the potentiometer 46 will become apparent as this description proceeds.

As shown in FIG. 1, the means 34 for generating the symmetrical signal includes a second transformer secondary 28 having a center tap 30 coupled directly to ground and output legs A and B coupled to the cathodes of first and second diodes 36 and 38, respectively. The anodes of diodes 36 and 38 are connected together at point C and to ground through a resistance 52 to avoid tolerance problems when diodes 36 and 38 are off.

The signal produced at point C as illustrated in FIG. 3*b* is a negative full wave rectified signal. Since the signal produced at point C and the potential supplied to the cathode/filament 13 are produced by secondaries driven by the same primary, the signal at point C is in phase with the cathode/filament potential. In the illustrated embodiment, the zero voltage point of the signal at point C is coincident in time with the zero crossing points of the cathode/filament AC voltage. The signal existing at point C may be characterized as a first control signal in phase with the voltage to the cathode/filament 13.

The control signal generating means 34 also includes a full wave rectifier 39 for producing a DC potential, which as illustrated includes diodes 40 and 42, whose anodes are coupled to the legs or output terminals A and B of the grounded center tap secondary 28 and whose cathodes are coupled to point D. A filter capacitor 43 is coupled between point D and ground, and a zener diode 51 has its anode coupled to ground and its cathode coupled through a current limiting resistance 50 to the output terminal D of the full wave rectifier. The zener diode 51, in combination with the full wave rectifier 39, the current limiting resistance 50, and the capacitor 43, establishes a substantially fixed DC potential $V_2$ as illustrated in FIG. 3*c* at a point E. In a preferred embodiment, this potential is 8–10 volts. Other DC potential establishing means such as batteries or other active or passive circuits can be used with equal advantage in alternate embodiments.

Capacitors 36A, 38A, 40A and 42A are coupled in parallel across the respective diodes 36, 38, 40 and 42 to reduce or eliminate radio frequency interference problems.

In the preferred embodiment illustrated in FIG. 1, a resistive voltage divider is coupled between points C and E and thus couples the full wave rectified signal at point C to the essentially fixed DC potential at point E. The voltage divider includes resistors 44, 46, and 48 which are coupled in series with each other between points C and E.

Figure 3:
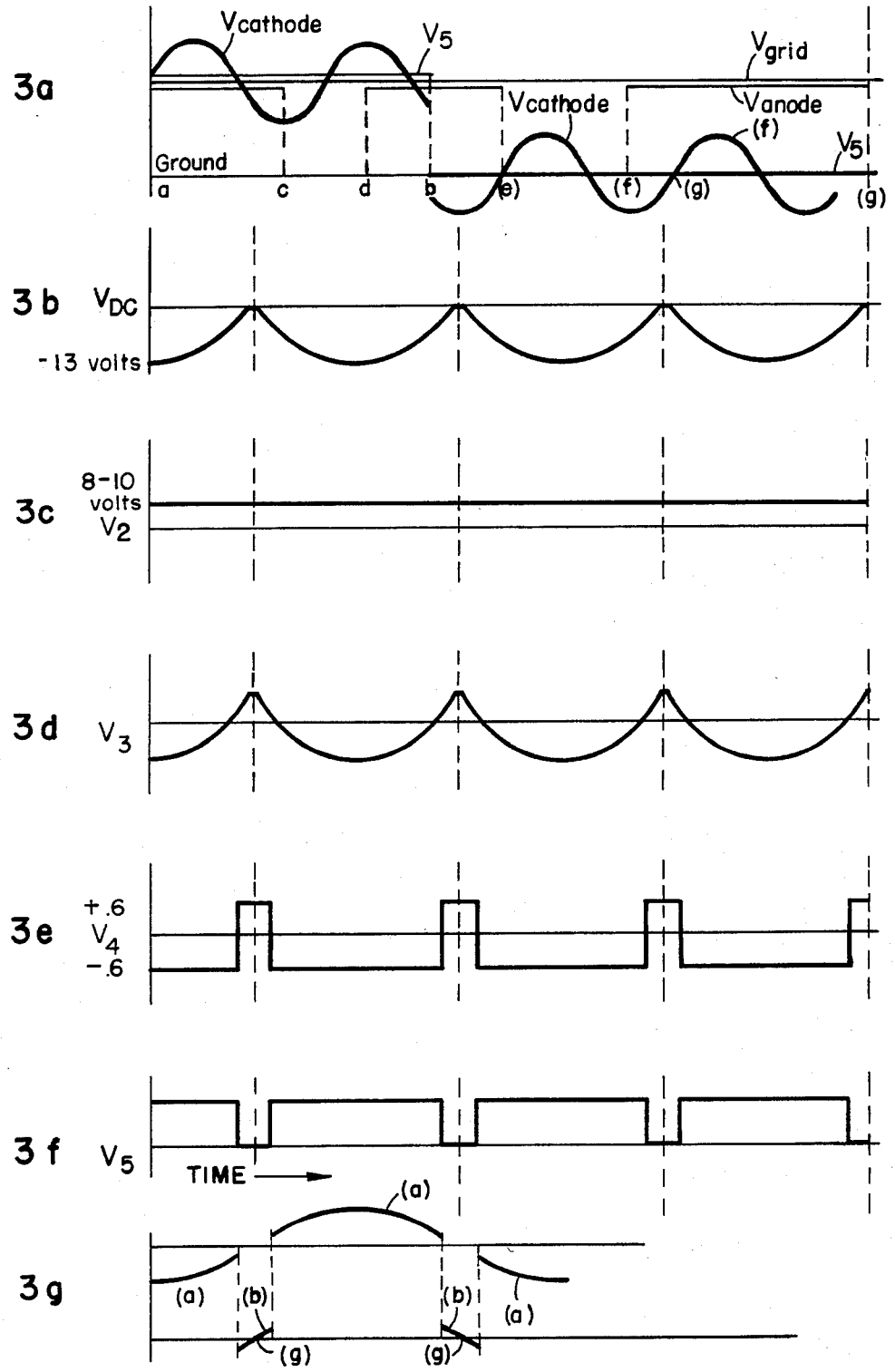

As shown in FIG. 1, the resistor 46 is a potentiometer and includes a wiper 47 coupling the voltage divider through a current limiting resistor 49 to the base of the transistor 52. The variable element can be manually adjustable to a particular selected setting, as will be explained in more detail in combination with FIG. 3, to adjust the potential of the signal supplied at the wiper 47 relative to the potentials at points C and E. In this manner, it is possible to adjust the peak magnitude of the signal supplied to the control terminal of the controllable switching means 26 and to thereby adjust the time interval during which the signal at the wiper 47 is sufficient to turn on the transistor 52. In the illustrated preferred embodiment, a diode 55 has its cathode coupled to the control terminal of the transistor 52 to afford a degree of protection against inadvertently excessively reverse biasing the transistor 52. The diode 55 can for instance clip the negative going portions of $V_3$, as illustrated in FIG. 3*e* at the negative 0.6 volt levels.

In the preferred embodiment of FIG. 1, the transistor 52 has its emitter coupled to ground, its collector coupled to the tap 25 of the transformer secondary 16, and its base coupled to the wiper 47 of the potentiometer 46 through the voltage dropping resistor 49. A capacitor 54 is coupled across the emitter/collector leads of the transistor 52 to help suppress radio frequency signals which can cause interference with radio receivers, particularly when the display 14 is included in a clock radio or the like. The transistor 52 responds to an applied control signal and conducts when the signal $V_4$ at the transistor base exceeds the forward bias threshold of the transistor 52 thereby coupling the center tap 25 to ground through the collector/emitter path. The transistor also clips the positive going portions of the waveform $V_3$ which are in excess of the predetermined bias level, which in one example is approximately 0.6 volts. The transistor 52 conducts only when the positive bias voltage is applied to its base. Thus the waveform of FIG. 3*e* is essentially that of FIG. 3*d* as transformed by the diode 55 and the transistor 52. More particularly, the positive bias voltage applied to the base of the transistor 52 constitutes a second control signal that is symmetrical about the zero crossing points of the potential to the cathode/filament 13. FIG. 3*f* illustrates the voltage existing at the secondary tap 25; when the transistor 52 is not conducting, the tap voltage floats at a high level, and when the transistor 52 is conducting, the tap voltage is maintained at ground voltage.

FIG. 3*g* is similar to FIG. 3*a* except that it shows the variation in the potential supplied to the cathode/filament 13 as the transistor 52 is toggled between its first, non-conductive state and its second, conductive state. In the non-conductive state, the cathode voltage is illustrated by curve (a) in FIG. 3*g*; in this operative state, the cathode voltage is too high for conduction, and the display segments cannot be illuminated even in the presence of an anode voltage. In the conductive state, however, the cathode voltage is reduced to the level shown by curve (b), and the presence of anode signals will cause the respective display segments to become illuminated for the period of time that the transformer tap 25 is connected to ground through the transistor 52.

The wiper 47 of the potentiometer 46 can be adjusted to control the magnitude of the voltage $V_3$. More particularly, the period of time that the voltage $V_3$ is positive can be increased by moving the wiper toward point E, and the period of time that the voltage $V_3$ is negative can be increased by moving the wiper toward point C. It will therefore be obvious that the period of time that the voltage $V_4$ at the base of the transistor 52 is sufficient to turn on the transistor 52 can be varied by adjusting the wiper. For example, if the wiper is moved toward point E, the voltage curve illustrated by FIG. 3*d* will move upwardly in the positive direction, and the period of time that the voltage $V_4$ (FIG. 3*e*) is at the positive turn on level (second signal level) will be correspondingly increased. Under these circumstances, the period of illumination as shown by curve (b) of FIG. 3*g* will be increased. Similarly, movement of the wiper toward point C will result in a shorter period of illumination. It is particularly within the scope of this invention to permit the wiper 47 to be adjusted to such an extent toward point C that the voltage $V_4$ is continuously below or less than the turn on threshold for the transistor 52. In such state, the display 14 will remain off regardless of the state of the anode and grid voltages. Similarly, moving wiper towards E can provide continuous on time and maximum brightness. The brightness of the display 14 is determined by the period or length of time during each cycle that the second control signal to the base of the transistor 52 exists, i.e., the period of time that the voltage $V_4$ is at the turn on level. The length of time that the voltage $V_4$ is at the turn on level is referred to as the duty cycle of the control signal. The duty cycle of the control signal thus establishes the portion of each cycle during which the display elements of the display 14 may be turned on by the appropriate anode voltage. Moreover, the second control signal of the present invention is symmetrical about the AC crossover point of the cathode/filament voltage. Since the human eye averages the duty cycle illumination, a short duty cycle will be perceived as low level illumination, and a longer duty cycle will be perceived as higher level, or bright, illumination.

Typical values for components which can be used in the circuit of FIG. 1 include the following:

| Schematic Information | Component Value |
|---|---|
| Diodes 36, 38, 40, 42, 55 | 1N4002 |
| Resistor 32 | 2,000 ohms |
| Resistor 44 | 1,200 ohms |
| Resistor 46 | 50,000 ohms |
| Resistor 48 | 8,200 ohms |
| Resistor 49 | 6,200 ohms |
| Resistor 50 | 750 ohms |
| Capacitors 36A, 38A, 40A, 42A | 0.01 μf |
| Capacitor 43 | 470 μf |
| Capacitor 54 | 0.01 μf |
| Zener Diode 51 | 1N5237 |
| Transistor 52 | 2N3414 |

As indicated previously, it is typical in vacuum fluorescent displays to have the cathode/filament extend throughout the display into proximity to anodes and grids at fixed potential. Since the cathode/filament 13 is supplied and heated by an AC electric current, different portions of the cathode/filament can simultaneously have significantly different potentials. These differences in potential are maximized when the potential difference across the cathode is greatest as at point (f) in FIG. 3*a*. If the center tap 25 of the transformer secondary 16 is grounded when the potential difference across the cathode/filament 13 is relatively great, as at point (f), and appropriate anode and grid voltages are simultaneously applied, the enabled display segments along the length of the cathode/anode will be illuminated, but the relative anode-grid-cathode voltages at the different display segments will be significantly different because of the significant voltage drop along the length of the cathode/anode. As a result, the different display segments will have substantially different brightnesses. This non-uniformity in brightness is particularly noticeable at low brightness levels. By the present invention, this problem is largely overcome through the utilization of a control signal (voltage $V_4$) having a duty cycle symmetrical about the crossover, or zero crossing, of the AC supply voltage since the potential variation along the length of the cathode/filament is minimized at and in the vicinity of the zero crossing of the supply voltage, as illustrated by points (g) in FIGS. 3*a* and 3*g*. As a result of this invention, the display brightness of the various display elements is perceived as being substantially uniform even at low brightness levels.

Referring now to FIG. 2, another embodiment of the present invention is illustrated in schematic form wherein similar numeric identifications have been provided to similar circuit elements. More particularly, FIG. 2 differs from FIG. 1 in the nature of the means for generating a symmetrical control signal. In general terms, the means for generating a symmetrical signal includes a single full wave rectifier 34' which is coupled to the legs A and B of a secondary 28' associated with a transformer primary 18', which itself can be connected to an AC source such as a 110 volt wall outlet.

In more detail, the secondary 28' has a grounded center tap 30' and output terminals A and B, which are coupled respectively to the anodes of diodes 70 and 72 whose cathodes are coupled in parallel to terminal C. A resistor 32 connects terminal C to ground to avoid tolerance problems when diodes 70 and 72 are off. Terminal C is also coupled to a resistive voltage divider comprising resistors 74, 75 and 76 coupled in series between terminal C and ground. A zener diode 73 is provided between ground and the junction of resistors 74 and 75. A manually operable single pole double throw switch 78 is coupled in parallel across resistor 76, the switch 78 having terminals 78A and 78B coupled to the grounded terminal of resistor 76 and terminal 78C coupled to the ungrounded terminal of resistor 76. The movable contact of the switch 78 can in its two positions connect contact 78B to either contact 78A, as shown in FIG. 2, or contact 78C.

When the switch contact interconnects terminals 78C and 78B, the HIGH position, resistor 76 is shorted and resistor 75 is thereby coupled to ground. In this switch position, the base of a first control NPN transistor 80 is also coupled to ground. Transistor 80 includes an emitter also coupled to ground and a collector coupled to the base of a second control NPN transistor 82. When, however, the switch contact interconnects terminals 78B and 78A, resistor 76 is not shorted. As a result, the voltage at the base of the transistor 80 is held at the voltage of the junction between resistors 75 and 76. The collector of transistor 80 is coupled through resistor 84 to the cathode of a zener diode 73, which is coupled to the full wave rectifier 34 through the current limiting resistor 74. The cathode of the transistor 80 is also coupled, as previously indicated, to the base of the transistor 82. The transistor 82 also includes an emitter coupled to ground and a collector coupled to the tap 25' of the filament secondary 16' for controllably coupling the tap 25' to ground. A capacitor 86 is coupled across the collector and emitter terminals of transistor 82 and, similarly, capacitors 70A and 72A are coupled across the respective diodes 70 and 72 to minimize radio frequency interference problems.

Figure 4:
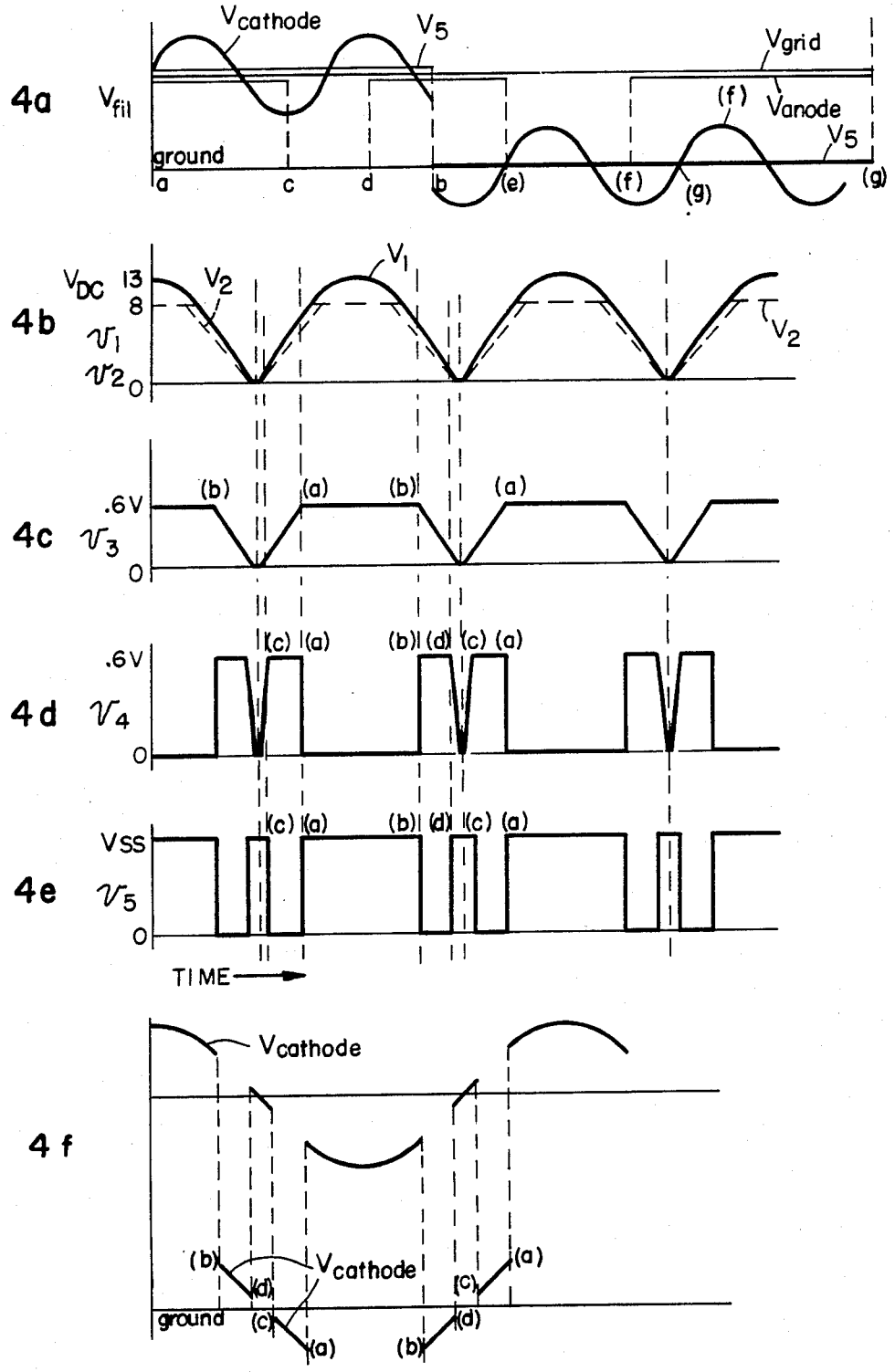

In the embodiment of FIG. 2, when the movable contact of the switch 78 connects contacts 78A and 78B, the control signal voltage $V_1$ (FIG. 4*b*) developed at the output C of the full wave rectifier is coupled to both the base of transistor 82 through resistors 74 and 84 and the base of transistor 80 through resistor 74 and voltage divider 75–76. The particular resistors 74, 75 and 76 and the zener diode 73 determine the level of the signal $V_3$ (FIG. 4*c*) which is applied to the base of the transistor 80. The voltage signal $V_3$ applied to the base of the transistor 80 can be expressed by the following equation:

$$V_3=[R_{76}/(R_{75}+R_{76})]\cdot V_2$$

where $V_2$ is the voltage signal (FIG. 4*b*) developed at the cathode of the zener diode 73. The resistors 74, 75, 76 and 84 along with the zener diode 73 modify the voltage signal $V_1$ produced at point C of the full wave bridge to produce modified control signals $V_2$, $V_3$ and $V_4$ as illustrated by FIGS. 4*b*, 4*c* and 4*d*, respectively.

In the illustrated embodiment, the switch 78 may also interconnect contacts 78B and 78C to shunt resistor 76 and couple the base of the transistor 80 continuously to ground. In this condition, the transistor 80 never conducts.

Typical components which can be used in the circuit of FIG. 2 include the following:

| Schematic Information | Component Value |
|---|---|
| Diodes 70, 72 | 1N4002 |
| Resistor 32 | 2,000 ohms |
| Resistor 74 | 750 ohms |
| Resistor 75 | 20,000 ohms |
| Resistor 76 | 7,500 ohms |
| Resistor 84 | 11,000 ohms |
| Capacitors 70A, 72A, 86 | 0.01 μf |
| Zener Diode 73 | 1N5237 |
| Transistor 80, 82 | 2N3414 |

As known to those skilled in the art, the secondary 16' continuously provides electric current to continuously heat the cathode/filament 13. In a preferred embodiment, this filament current is approximately 75 ma. The cathode voltage, as shown in FIG. 4*a*, is determined by the conductive state of the transistor 82, i.e., whether or not the tap 25' is coupled to ground. When the tap 25' is ungrounded, the voltage $V_5$ at the tap 25' floats to the value illustrated by time interval (a)–(b) of FIG. 4*a* (same as FIG. 3*a*). When the tap 25' is grounded through the forward biased transistor 82 of FIG. 2, voltage $V_5$ at the tap 25' is shifted to ground, and the cathode/filament waveform is centered about ground as illustrated by time interval (b)–(g) of FIG. 4*a*. It should be recognized that the particular reference potential chosen for the cathode tap potential does not affect the operation of the cathode/filament heater circuit; the combination cathode/filament 13' continuously receives approximately a 75 ma filament current. However, the center tap potential does affect operation of the display. More particularly, as described above, the tap 25' completes the circuit path from the segment driver 22' through the display anode terminals 20' to the cathode 13' to the tap 25' through the forward biased transistor 82 of FIG. 2 to the reference potential. It is only when the cathode/filament potential is lower than the potentials applied to the display anodes 20 and the grids 24 that the selected display segment becomes illuminated. Accordingly, it is within the scope of this invention to provide illumination by referencing the tap 25' to any voltage potential at which the resulting cathode voltage is sufficiently less than the associated anode and grid voltages; this reference voltage is most conveniently ground as illustrated herein.

The waveform illustrated in FIG. 4*b* represents the potential $V_1$ supplied at the output of the full wave rectifier of FIG. 2; in this embodiment, the maximum voltage of the rectified voltage signal is about 13 volts. This first control signal is in phase with the potential supplied to the cathode/filament 13. In the embodiment of FIG. 2, the zener diode 73 and the limiting resistor 74 clip the peaks of the full wave output signal $V_1$ provided by the rectifier circuits to produce the voltage signal $V_2$ illustrated by the dashed lines of FIG. 4*b*; the zener diode 73 may typically clip the voltage $V_2$ at a level of about 8 volts.

FIG. 4*c* illustrates the voltage signal $V_3$ applied to the base of the transistor 80 by the resistive voltage divider 75–76 when the switch 78 interconnects contacts 78A and 78B to keep the resistor 76 in the circuit. The voltage signal $V_3$ has the same general shape as $V_2$, but a reduced magnitude due to the voltage drop across resistor 75. More particularly, the compressed voltage $V_3$ reaches the forward bias, or turn on, voltage of the transistor 80, at which time (point (a) in FIG. 4*c*) the transistor 80 turns on or conducts, and the voltage $V_3$ is held or clipped at such level until the point (point (b) in FIG. 4*c*) at which the voltage produced by the action of the voltage divider 75–76 drops below the threshold voltage of the transistor 80. Assuming a fixed voltage $V_2$, the conduction period of the transistor 80, the time period between points (a) and (b) of FIG. 4*c*, is determined by the resistance values of the resistors 75 and 76. If, for example, the resistance of resistor 76 is increased, the voltage $V_3$ will be a less compressed image of voltage $V_2$, and the turn on point (a) will be reached sooner, and the turn-off point (b) will be reached later. As a result, the transistor 80 will conduct for a longer period of time. Similarly, a reduction in the resistance of resistor 76 will result in a reduced conduction time. If, of course, the resistance of resistor 76 is reduced to zero by moving the switch 78 to interconnect contacts 78B and 78C, the transistor 80 will not conduct for any period.

Referring now to FIGS. 2 and FIGS. 4*b*–4*f*, the second control voltage signal and its control of transistor 82 will be described. With the switch 78 interconnecting contacts 78A and 78B, the voltage $V_4$ at the base of the transistor 82 is substantially equal to voltage $V_2$ so long as the voltages $V_2$ and $V_4$ are less than the threshold voltage of the transistor 82. When, however, the voltages $V_2$ and $V_4$ reach the threshold voltage, say 0.6 volt, the transistor 82 turns on to connect the voltage $V_5$ of the center tap 25' through the transistor 82 to ground. Assuming the presence of an appropriate anode voltage, this action will cause the display elements of the display 14 to become illuminated beginning at point (c) in FIGS. 4*c*–4*f*. Since voltage $V_4$, unlike voltage $V_3$, is not a compressed version of voltage $V_2$, the turn on point (c) of transistor 82 is reached much more quickly than the turn on point (a) of transistor 80.

Once the threshold voltage of transistor 82 is reached, the voltage $V_4$ is clipped at the threshold level until the voltage $V_3$ reaches point (a) (FIG. 4*c*) at which time transistor 80 turns on. At this point in time, conduction of the transistor 80 pulls the base voltage $V_4$ of the transistor 82 to ground. As a result, the transistor 82 ceases conduction, and the center tap voltage $V_5$ rises to turn off the display elements. While the transistor 80 conducts during time period (a)-(b), voltage $V_4$ remains tied to ground, and the display remains off. At point (b), however, the transistor 80 turns off and transistor 82 turns on again to permit illumination. Finally, at point (d), the voltage $V_4$ drops below the threshold voltage of the transistor 82, and the transistor 82 stops conducting until the next point (c) is reached. During the time period (d)-(c), the transistor 82 is off and the display elements are not illuminated. Illumination is thereafter provided during the next period (c)-(a).

It will thus be seen that the control arrangement of FIG. 2 is similar to that of FIG. 1 in that it ties the voltage $V_5$ at the center tap 25' to ground for periods (b)-(d) and (c)-(a) that are symmetrical about the zero crossings of the supply voltage shown by FIG. 4*a* and FIG. 4*f*. As indicated previously, the second control signal present during this symmetrical conduction period about the zero crossings of the AC supply voltage promotes uniform illumination over the entire display.

If the switch 78 is adjusted to interconnect terminals 78B and 78C, the resistor 76 is permanently shorted out and the transistor 80 never conducts. Under this circumstance, the conduction period of the transistor 82 and the illuminated period of enabled display elements extend for the entire period from point (c) in FIG. 4*d* to the subsequent point (d) with no intermediate off period (a)-(b). The transistor 82 and the enabled display segments turn off only for the brief period (d)-(c) that the voltage $V_4$ is below the threshold voltage of the transistor 82.

From the foregoing, it will be appreciated that the control arrangement of FIG. 2 provides two-level illumination of the display elements. In particular, when the switch 78 does not shunt out resistor 76, the enabled display segments are illuminated only for the relatively brief periods (b)-(d) and (c)-(a). The brief periods of illumination in each cycle of the supply voltage are averaged by the eye, appearing to be low level, or relatively dim, illumination. When, however, the switch 78 shunts out the resistor 76, illumination is provided for the much longer period (c)-(d). This illumination is perceived by the eye to be much brighter due to the averaging action provided by the eye.

As in the case of the variable potentiometer 46 of the control circuit of FIG. 1, a selected one of the resistors 75 and 76 can be replaced by a manually variable resistance so that the relative conduction periods can be varied to vary the perceived brightness of the display elements. For example, a decrease in the resistance of the resistor 76 results in a decreased conduction period (a)-(b) of transistor 80, increased conduction and illumination periods (b)-(d) and (c)-(a) for the transistor 82 and the display elements, respectively. Similarly, the illumination period and apparent brightness can be decreased by increasing the resistance of the resistor 76. This type of selective control may be provided conveniently by an adjustable potentiometer in place of the resistor 76. Similarly, the variable element could be provided by an automatically adjusting device such as a photocell. Thus, increased illumination could be provided by replacing the resistor 76 with a device which automatically decreases its resistance as the ambient light level increases.

The control signal of the present invention is developed from a 60 Hz, 110 volts, AC waveform and employs only resistive components to modify the magnitude of the derived symmetrical signal. As such, this circuit is not susceptible to circuit instabilities or component tolerances which would cause the circuit to react in a non-preferred manner. Accordingly, each of the aforedescribed circuits provides a means which reacts in a substantially uniform manner and can be manufactured on a mass production basis. It will therefore be appreciated that the present invention provides a practical and improved vacuum fluorescent display control circuit having improved and substantially uniform brightness control capability which is readily adaptable to a number of different circuit embodiments. Although the preferred embodiment of this invention has been described in some detail with reference to the circuits of FIGS. 1 and 2 and the waveforms of FIGS. 3 and 4, it is readily apparent that the improved symmetrical duty cycle brightness control circuit of the present invention can assume a variety of different electrical expressions and can be used in combination with a variety of different display, timer, and power supply circuit configurations. Various possible modifications of the variable control elements have been previously described. The transistor switching devices utilized in the illustrated embodiments of the invention could be replaced by other switching devices such as SCR's, op-amps, voltage comparators, or logic gates. In such cases, it will be necessary to make appropriate variations in the circuitry and control signals to provide the desired symmetrical illumination of the display elements. Such modifications will readily occur to those skilled in the art as a result of the teachings of this specification.

Although the invention has been described in its preferred form with a certain degree of particularity, it is understood that the present disclosure of the preferred embodiment is made by way of example and that modifications, specifically including without limitation those described above, in the details of construction may be resorted to without departing from the true spirit and scope of this invention. It is intended that the patent shall cover, by suitable expression of the appended claims, whatever features and patentable novelty exists in the invention disclosed.

What is claimed as new and is desired to secure by Letters Patent is:

1. A brightness control for a vacuum fluorescent display comprising:

a vacuum fluorescent display having anode, grid and cathode terminals, said anode and grid terminals adapted for coupling to means for supplying selected voltages thereto, means coupled to said cathode terminals for supplying substantially continuous AC potential thereto, and control means having first and second operative states coupled to said means for supplying AC potential to said cathode terminals, said control means being responsive to said means for supplying AC potential such that said control means assumes said second operative state only during time periods symmetrical about the zero crossings of the AC potential, said means for supplying AC potential being responsive to the first operative state of said control means to supply said AC potential at a first level and being responsive to the second operative state of said control means to supply said AC potential at a second level, and said vacuum fluorescent display producing light output only in response to the delivery thereto simultaneously of the selected voltages to said anode and grid terminals and AC potential at said second level to said cathode terminals, whereby light output is produced only during time periods symmetrical about the zero crossings of the AC potential supplied to the cathode terminals.

2. A brightness control for a vacuum fluorescent display as defined by claim 1 in which said control means includes adjustable means for selectively varying the duration of the time period symmetrical about the zero crossing of the AC potential so as to vary the on-time and perceived brightness of said vacuum fluorescent display.

3. A brightness control as defined by claim 2 in which said adjustable means is manually adjustable such that the perceived brightness may be selectively varied by an operator.

4. A brightness control as defined by claim 3 in which said adjustable means is a resistance element.

5. A brightness control as defined by claim 1 in which said cathode also comprises an heating filament, whereby AC potential continuously supplied to said cathode terminals continuously maintains said cathode in a heated state.

6. A brightness control as defined by claim 1 in which said means for supplying AC potential to said cathode terminals comprises a transformer having a secondary thereof including output terminals connected to said cathode terminals and a tap connected to said control means, said control means in its first operative state causing the voltage of said secondary to assume said first level and said control means in its second operative state causing the voltage of said secondary to assume said second level, the voltages along the cathode being substantially lower than the selected anode and grid voltages only when the secondary voltage is at said second level, whereby display illumination is only possible when said control means is in its second operative state.

7. A brightness control as defined by claim 6 in which said control means includes a controllable switching means having a first non-conductive state and a second conductive state connected between said tap and a source of ground potential, said first non-conductive state and said second conductive states constituting said first and second operative states, respectively, of said control means, whereby the potential at said tap is fixed to ground potential when said control means is in its second operative state.

8. A brightness control as defined by claim 7 in which said controllable switching means comprises a semiconductor switching device having a control terminal, said control means further comprising:

first signal producing means coupled to said transformer for supplying AC potential to said cathode terminals, said first signal producing means producing a first control signal in phase with the AC potential to said cathode terminals, second signal producing means coupled to said first signal producing means and said control terminal of said semiconductor switching device, said second signal producing means being responsive to said first control signal to produce and deliver to said control terminal a second control signal symmetrical about the zero crossings of the AC potential, said semiconductor switching device switching to its second conductive state whenever a second control signal is supplied to said control terminal of said semiconductor switching device.

9. A brightness control as defined by claim 8 in which said second signal producing means includes adjustable means for varying the time duration of said second control signal to vary the perceived brightness of said vacuum fluorescent display.

10. A brightness control as defined by claim 9 in which said adjustable means is manually adjustable.

11. A brightness control as defined by claim 9 in which said adjustable means is a potentiometer.

12. A brightness control as defined by claim 9 in which said semiconductor switching device is a transistor.

13. A brightness control as defined by claim 8 in which said second signal producing means produces said second control signal during discrete portions only of each cycle of the AC potential, said second control signal being produced for a continuous time period symmetrical about and including the zero crossings of the AC potential.

14. A brightness control as defined by claim 13 in which said second signal producing means includes adjustable means for varying the time duration of said second control signal to vary the perceived brightness of said vacuum fluorescent display.

15. A brightness control as defined by claim 14 in which said adjustable means is manually adjustable.

16. A brightness control as defined by claim 14 in which said adjustable means is a potentiometer.

17. A brightness control as defined by claim 14 in which said semiconductor switching device is a transistor.

18. A brightness control as defined by claim 8 in which said second signal producing means produces said second control signal during discrete portions only of each cycle of the AC potential, said second control signal being produced for time periods symmetrical about but not including the zero crossings of the AC potential.

19. A brightness control as defined by claim 18 in which said second signal producing means includes adjustable means for varying the time duration of said second control signal to vary the perceived brightness of said vacuum fluorescent display.

20. A brightness control as defined by claim 19 in which said adjustable means is manually adjustable.

21. A brightness control as defined by claim 19 in which said adjustable means is a potentiometer.

22. A brightness control as defined by claim 19 in which said semiconductor switching device is a transistor.

* * * * *